United States Patent [19]

Mrenna et al.

[11] 4,286,242

[45] Aug. 25, 1981

[54] MECHANICAL INTERLOCK FOR LOW VOLTAGE CIRCUIT BREAKERS

[75] Inventors: Stephen A. Mrenna, Brighton Township, Lawrence County; Alfred E. Maier, Chippewa; Glenn R. Thomas, Brighton Township, Lawrence County, all of Pa.

[73] Assignee: Westinghouse Electric Corp., Pittsburgh, Pa.

[21] Appl. No.: 75,766

[22] Filed: Sep. 17, 1979

[51] Int. Cl.[3] ..... H01H 33/46

[52] U.S. Cl. ..... 335/160; 200/50 C

[58] Field of Search ..... 335/160; 200/50 C

[56] References Cited

U.S. PATENT DOCUMENTS

| | | | |
|---|---|---|---|
| 3,750,059 | 7/1973 | Patel et al. | 335/142 |
| 3,778,633 | 12/1973 | De Visser et al. | 200/50 C |
| 3,815,063 | 6/1974 | Grunert et al. | 335/160 |
| 4,114,005 | 9/1978 | Maier et al. | 200/153 G |

*Primary Examiner*—Harold Broome

*Attorney, Agent, or Firm*—L. P. Johns

[57] ABSTRACT

An electric control system characterized by a pair of spaced circuit breakers and a mechanical interlock therebetween, each circuit breaker having a pair of stationary and movable contacts and a trip bar for opening the contacts, and the interlock extending between the movable contact means of each movable contact of one circuit breaker and the trip bar of the other circuit breaker.

4 Claims, 6 Drawing Figures

MECHANICAL INTERLOCK FOR LOW VOLTAGE CIRCUIT BREAKERS

BACKGROUND OF THE INVENTION

1. Field of the Invention

This invention related to mechanical interlocks between a pair of circuit breakers for preventing one of the circuit breakers from closing when the other breaker is closed.

2. Description of the Prior Art

The operation in control of electrical systems, including such devices as reversible motors and multi-speed motors, usually includes a circuit breaker for each motor function. A typical circuit includes, for example, a separate manual button for each breaker for the forward and reverse directions of a motor and for each speed of a multi-speed motor. As a result, actuation of one forward or reverse circuit includes an associated circuit for deactivating the other of the forward and reverse circuits. Notwithstanding such precautions, however, it sometimes occurs due to inadvertence or other reasons that both circuits (forward and reverse control buttons), are actuated simultaneously and thereby cause incorrect phase-to-phase line connections. Another typical circuit involves transfer circuits with normal and emergency sources for which one circuit breaker must be prevented from closing when the other breaker is closed. Thus, there is a need for an interlock between the circuit breakers.

Various interlock devices have been provided for overcoming the problem of simultaneous actuation of circuit interrupters. However, most of such interlocks have not been completely satisfactory for various reasons.

SUMMARY OF THE INVENTION

In accordance with this invention there is provided electric control system comprising at least two control devices in spaced adjacent positions and a mechanical interlock, each control device including movable contact means and a stationary contact structure, a movable contact carrier movable between open and closed positions of the contacts, operating means releasable from a latched position to effect opening of the contact arm means, trip means operable between latched and unlatched conditions and biased in the unlatched condition for releasing the operating means, the mechanical interlock having first and second link means for preventing the contacts of both control devices from being closed simultaneously, the first link means extending between the contact arm means of one control device and the trip means of the other control device, the second link means extending between the control arm means of the other control device and the trip means of said one control device, one link means holding the trip means of one control device in unlatched condition when the contact arm means of the other control device is in the closed position, the other link means being disengaged of the trip means of the other control device when the movable contact carrier of the one control device is in the closed position, each link means comprising a rotatable shaft and a plunger at each end thereof, bracket means on each end link for each plunger for rotating the shaft, one plunger connected to the control arm means and to one of the bracket means, and the other plunger being operatively connected to the trip means and to the bracket means at the other end of the shaft.

The advantage of the mechanical interlock of this invention is that the closed breaker must first be opened before the other breaker can be closed. Moreover, one closed breaker holds the other breaker in the open position and while in this position, the main contacts cannot be moved toward the closed position. Finally, lighter mass and inertia of rotating shafts allow better interlocking operation and allows greater distance between breakers. Distance can also be changed easily by changing length of shafts.

DESCRIPTION OF THE PREFERRED EMBODIMENT

Figure 1:
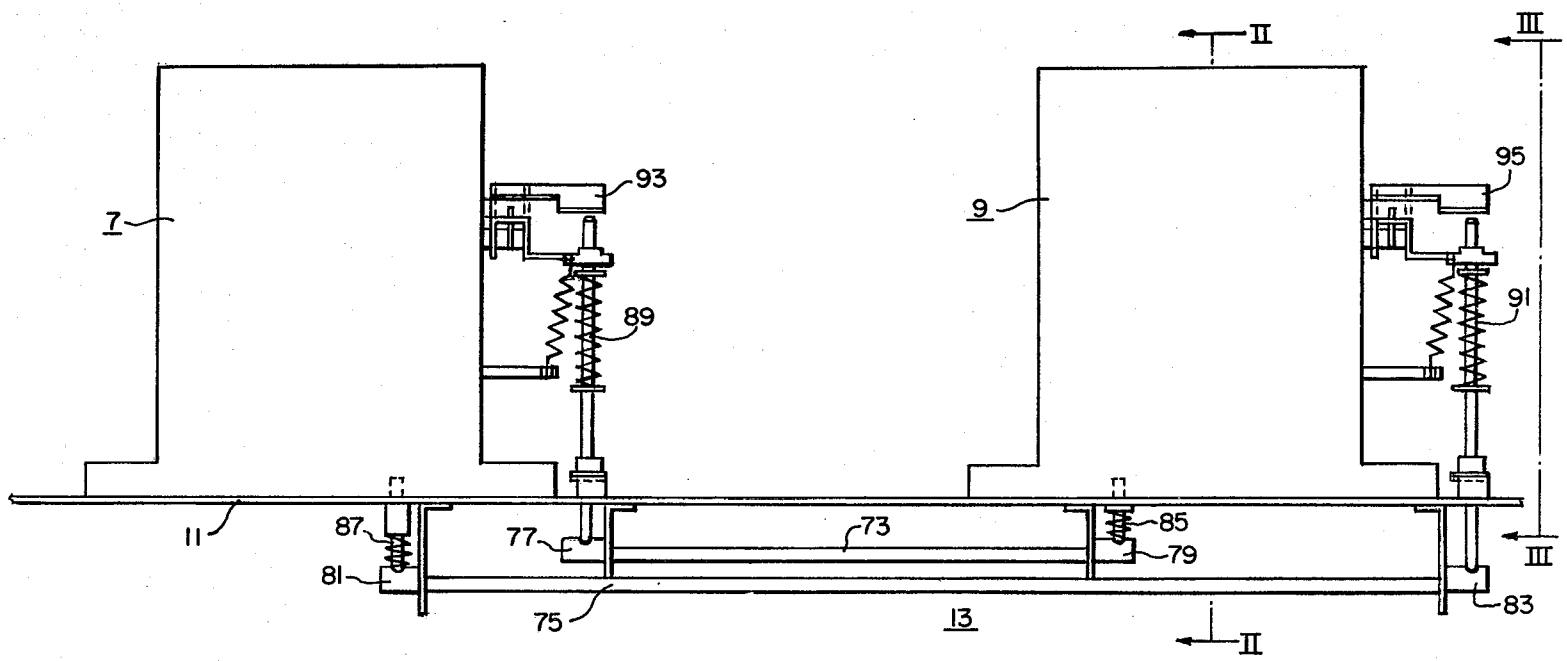
FIG. 1 is an elevational view of a pair of spaced circuit interrupters with interlocking means therebetween, in accordance with this invention.

In FIG. 1 a pair of circuit breakers, generally indicated at 7, 9, are disposed in spaced relation and mounted on a support base 11. A mechanical interlock generally indicated at 13 extends between and is operatively connected to the spaced circuit breakers. The circuit breakers 7, 9 are preferably similar in construction and operation and are of the type that is generally disclosed in U.S. Pat. No. 4,114,005, issued Sept. 12, 1978, and incorporated by reference herein. Because of the full disclosure in that patent, the description herein of the circuit breakers 7 and 9 is limited to the particular parts necessary to the description of the structure and operation of this invention.

Each circuit breaker 7, 9 comprises an insulating house 15 (FIG. 2) and a circuit breaker mechanism 17 supported within the housing. The housing 15 comprises an insulating base 19 and a detachable cover 21.

The circuit breaker mechanism 17 includes an operating mechanism 23, and a latch and trip device 25. Each circuit breaker 7, 9 is a three-pole circuit interrupter comprising three side-by-side compartments. The center compartment is separated from the two outer pole compartments by insulating barrier walls formed in the housing base 19. The circuit breaker mechanism 17 is disposed in the center pole compartment and operates the contacts for all three pole units.

Each pole unit includes a stationary contact 27 on a line conductor 29. A movable contact 31 is mounted on a movable contact arm 33 which is pivotally mounted at a pivot point 35 which is common for all of the contact arms of the three poles. Each pole also comprises a moving arcing contact 37 and a stationary arcing contact 39 the former of which is on the arcing contact arm 33.

A clamp 41 is mounted on each contact arm 33 and is comprised of an electrically insulating material. The clamps of all three contact arms include aligned apertures 43 through which a cross bar 45 extends over the three poles. The cross bar 45, being connected to the operating mechanism, moves the contact arms 33 up and down between open and closed positions of the contacts 27, 31. Thus, in the open position, the contact arm 33 is raised as indicated by the broken line position of the arm 33, and by the broken line position of the cross bar 45. When the contacts are closed (as shown in the solid line position of the arm and cross bar), a circuit through the circuit breaker 7 moves from the line conductor 29 and through the contacts 27, 31, the arm 33, the pivot pin 35, and a conductor 47.

Figure 2:
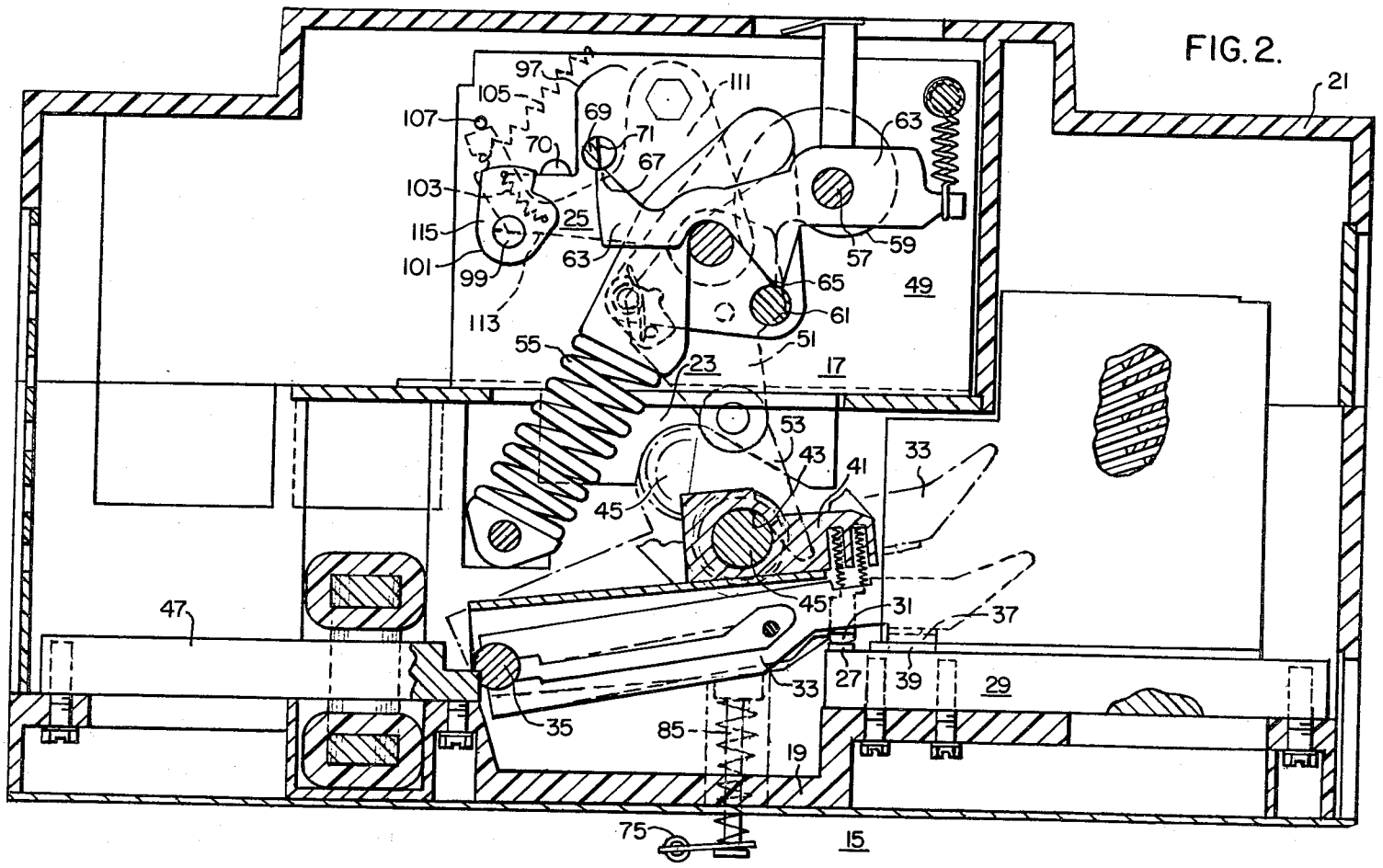
FIG. 2 is a vertical sectional view taken on the line II—II of FIG. 1.

The operating mechanism 23 actuates the switch arm 33 between the open and closed positions. The mechanism is disposed between a pair of spaced support frames of which one frame 49 is shown in FIG. 2. The mechanism 23 comprises a toggle including an upper pair of spaced toggle links of which one link 51 is shown, and a lower pair of spaced apart toggle links of which one link 53 is shown, and a closing spring assembly 55. The spring assembly 55 is charged with stored energy by a charged structure including a driven shaft 57 and a cam 59 which actuates a cam roller 61, whereby the closing spring assembly 55 is actuated from the discharge to a charge condition for closing the contacts.

The device comprises a closing latch mechanism that comprises a latch lever 63 which is pivotally mounted on the shaft 57 and which comprises a first surface 65 and a second surface 67. When the cam 59 rotates sufficiently to fully charge the closing spring assembly 55, the cam roller 61 comes to rest upon the first surface 65 of the latch lever 63. At the same time, the second surface 67 has been rotated below the curved surface of a rotatable trip shaft 69 having a notch 71, whereby the shaft retains the latch lever 63 in the latched position as shown in FIG. 2.

The latch and trip device 25 (FIG. 2) comprises of a latch member release lever 97, the D-shaft 70 and a second D-shaft 99, a catch 101, biasing springs 103 and 105, and a stop pin 107. To release the operating mechanism 23 the latch member release member 97 is depressed which causes a clockwise rotation of the D-shaft 70. The catch 101 which has been resting on the D-shaft 70 and biased for counterclockwise rotation by the spring 103, moves clockwise allowing a corresponding clockwise movement of the shaft 99 on which the catch 101 is fixedly secured. The clockwise movement of the D-shaft 99 causes a toggle latch lever 111 to move in a counterclockwise direction, thereby releasing the toggle of the toggle link assembly. After the toggle link assembly has been released, and the movable contact 31 positioned in the open position, the biasing spring 105 returns the toggle latch lever 111 to a position wherein the surface 113 is resting upon the D-shaft 99. To prevent the toggle latch lever 111 from moving too far in the clockwise direction, a stop pin 107 is utilized to stop the toggle latch lever 111 at its correct location. The mechanical advantage of this release system occurs because of the very slight clockwise rotation of the D-shaft 70 which releases D-shaft 99 which then releases the lever 111 as compared to the larger rotation of the latch release lever 97.

In accordance with this invention a mechanical interlock may be provided between the spaced circuit breakers 7, 9. The interlock 13 comprises (FIG. 1) a pair of elongated rotatable shafts 73, 75, an arm fixedly mounted at each end of the shaft including similar arms 77, 79 at opposite ends of the shaft 73, as well as arms 81, 83 at opposite ends of the shaft 75.

Figure 3:
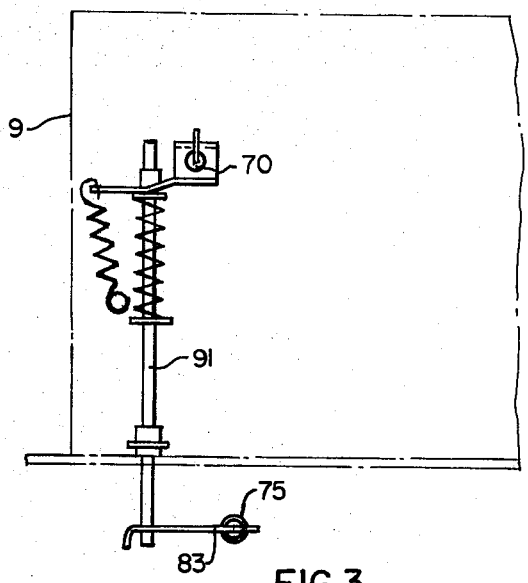
FIG. 3 is a vertical sectional view taken on the line III—III of FIG. 1.

In addition, plungers 85, 87 are disposed at opposite ends of the rotatable shaft 73, 75 and operatively connected at their lower ends to corresponding arms 79, 81, respectively. Elongated rods 89, 91 extend from the opposite ends of the shafts 73, 75, respectively, and operate from the arms 77, 83. The upper ends of the rods function with shaft arms 93, 95, as shown more particularly in FIG. 3, for the rod 91 and shaft arm 95 which is mounted on the end of the trip shaft 69 of the circuit breaker 9. The upper ends of the plungers 85, 87 engage the movable contact arm 33.

Figure 4:
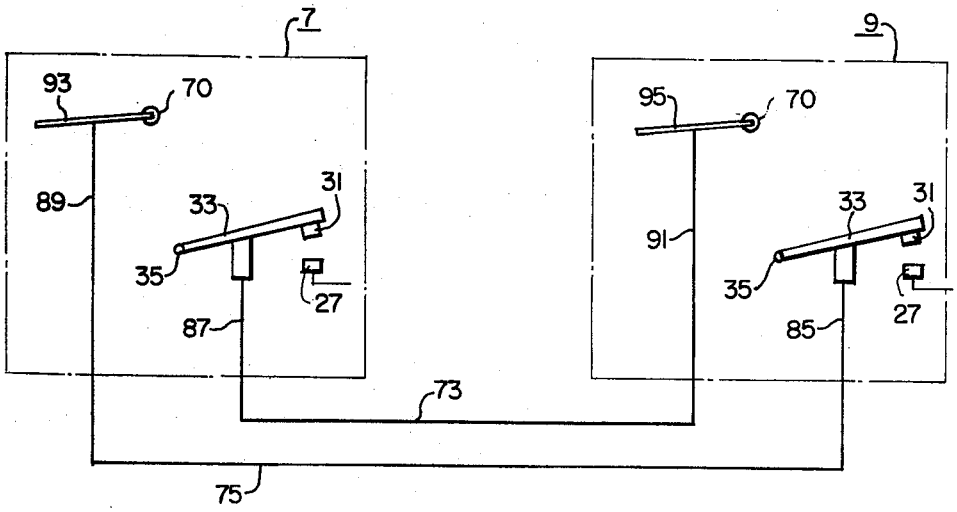
FIGS. 4, 5, and 6 are diagrammatic views of different interlock conditions between two spaced circuit breakers.
Figure 5:
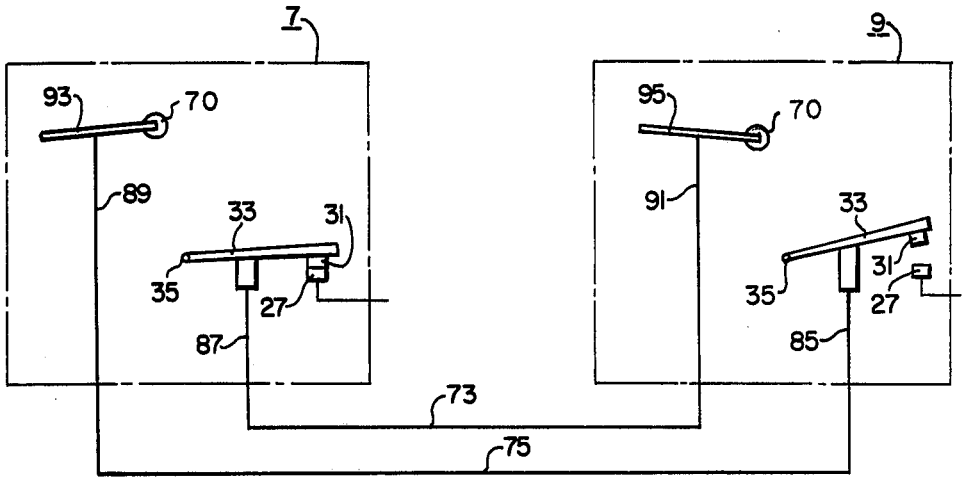
Figure 6:
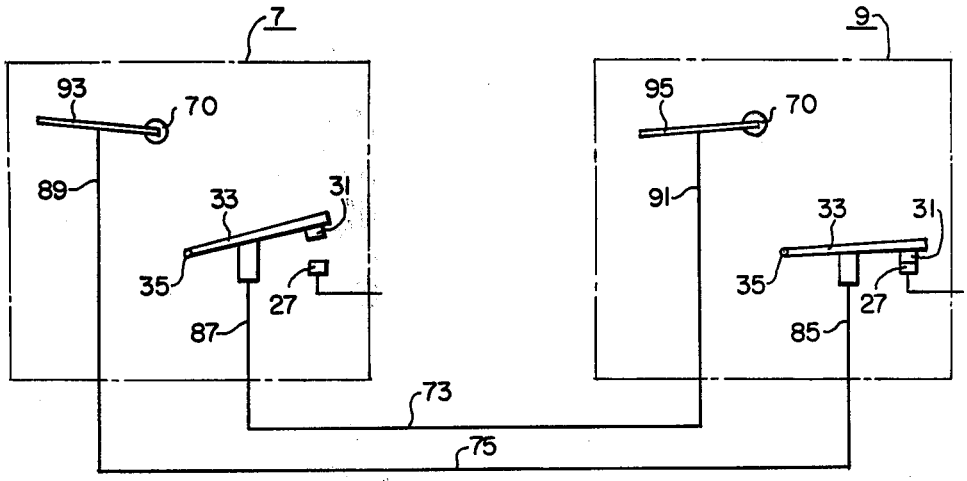

Operation of the mechanical interlock is shown schematically in FIGS. 4, 5 and 6. In FIG. 4 both circuit breakers 7, 9 are in the open position as indicated by the raised position of the contact arm 33 with respect to the stationary contact 27. The shafts 73, 75, the plungers 85, 87 and the rods 89, 91 are indicated by the referenced lines in FIGS. 4, 5 and 6. As shown the shaft 73 functions between the contact arm 33 of the circuit breaker 7 and the latch shaft 70 of the circuit breaker 9. Similarly, the shaft 75 functions between the latch shaft 70 of the circuit breaker 7 and the contact arm 33 of the circuit breaker 9. When both circuit breakers 7, 9 are open, the latch shafts may be in either unlatched or latched positions, the latter position of which is shown in FIG. 4. The circuit breaker 7 is closed as indicated by the closed position of the contacts 27, 31 and the latch shaft 70 is latched as indicated by the position of the shaft arm 93. Inasmuch as the cam arm of the circuit breaker 9 is in the closed position, the plunger 87 is depressed to rotate the shaft 73 which in turn raises the rod 91 to lift the shaft arm 95 and thereby rotate the latch shaft 70 to the unlatched position, whereupon the contact arm 33 cannot be lowered to close the contacts 27, 31 in the circuit breaker 9.

In FIG. 6 the reverse condition of that shown in FIG. 5 obtains. That is, the contact arm 33 of the circuit breaker 9 is lowered to close the contacts 27, 31 and to move the plunger 85 downward to rotate the shaft 75 and to move the rod 89 up to rotate the shaft arm 93 which in turn rotates the latch shaft 70 to the unlatched position in the circuit breaker 7. Conversely, inasmuch as the contact arm of the circuit breaker 7 cannot be lowered the shaft arm 95 in the circuit breaker 9 remains in the latched position for the latch shaft 69.

In conclusion, the mechanical interlock of this invention provides for a condition in which a closed circuit breaker holds the other breaker in the open position and the main contacts of the other cannot be moved to the closed position. Accordingly, where one circuit breaker drives a motor in a forward position and the other circuit breaker drives the motor in the reverse position, both circuit breakers cannot be actuated simultaneously. Also, the interlock may be used for transfer circuits with normal and emergency sources to prevent closing of one breaker when the other is closed.

What is claimed is:

1. An electric control system comprising at least two control devices in spaced adjacent positions and a mechanical interlock, each control device comprising movable contact means and a stationary contact structure, a movable contact carrier movable between open and closed positions of the contacts, operating means releasable from a latched position to effect opening of the contact arm means, trip means operable between latched and unlatched conditions and biased in the unlatched condition for releasing the operating means, the mechanical interlock comprising first and second link means for preventing the contacts of both control devices from being closed simultaneously, the first link means extending between the contact carrier of one control device and the trip means of the other control device, the second line means extending between the contact carrier of the said other control device and the trip means of said one control device, the first link means holding the trip means of said control device in the unlatch condition when the contact carrier of the other control device is in the closed position, and the second link means holding the trip means of said other control device in the latched condition when the movable contact carrier of said one control device is in the open position.

2. The system of claim 1 in which each link means comprises a movable interconnecting link and a plunger at each end thereof, one plunger operatively connected to the contact carrier, and the other plunger being operatively connected to the trip means.

3. The system of claim 2 in which each link is a shaft rotatable on its longitudinal axis.

4. The system of claim 3 in which each trip means comprises a notched rotatable shaft.

* * * * *